United States Patent [19]

Morishita et al.

[11] Patent Number: 4,596,746

[45] Date of Patent: Jun. 24, 1986

[54] POWDER SHEET FOR SINTERING

[75] Inventors: Tuyoshi Morishita; Sigemi Osaki, both of Hiroshima, Japan

[73] Assignee: Mazda Motor Corporation, Hiroshima, Japan

[21] Appl. No.: 724,315

[22] Filed: Apr. 17, 1985

[30] Foreign Application Priority Data

Apr. 20, 1984 [JP] Japan ..... 59-79553

[51] Int. Cl.[4] ..... B32B 15/08

[52] U.S. Cl. ..... 428/458; 75/246; 75/247; 419/9; 419/23; 419/36; 419/37; 419/40; 419/54; 428/546; 428/548; 428/652; 428/908.8

[58] Field of Search ..... 419/23, 54, 40, 8, 9, 419/36, 37; 75/246, 247; 428/546, 458, 548, 652, 908.8

[56] References Cited

U.S. PATENT DOCUMENTS 4,259,112 3/1981 Dolowy et al. ..... 419/40 X

FOREIGN PATENT DOCUMENTS 51-83834 7/1976 Japan .
53-19540 6/1978 Japan .
55-21802 6/1980 Japan .

*Primary Examiner*—Stephen J. Lechert, Jr.
*Attorney, Agent, or Firm*—Fleit, Jacobson, Cohn & Price

[57] ABSTRACT

A metal powder sheet for use for forming a sintered layer on a metal substrate. The sheet includes powders of a metal which provides a required physical property such as wear-resistance and ultra-fine powders of a metal having a powder size finer than 1 micron. These powders are kneaded with an addition of an acryl resin as a binder. The ultra-fine powders make it possible to carry out the sintering process at a lower temperature.

4 Claims, 3 Drawing Figures

(x 400)

POWDER SHEET FOR SINTERING

BACKGROUND OF THE INVENTION

1. Field of the Invention

The present invention relates to a material sheet adapted for use in forming a sintered layer on a surface of a metal substrate. More particularly, the present invention relates to a powder sheet which can be sintered under a relatively low temperature.

2. Description of Prior Art

It has been known to provide an alloy powder sheet which is used for forming a sintered layer on a metal surface. Such a powder sheet has been generally produced by kneading alloy powders with a synthetic resin and rolling the mixture into a sheet form. The sheet is fitted to a surface of a metal substrate and thereafter heated to a sintering temperature to have the alloy powders sintered to thereby form a sintered alloy layer on the surface of the metal substrate. For example, the Japanese patent application No. 50-9398 filed on Jan. 21, 1975 and disclosed for public inspection under the disclosure number 51-83834 proposes to provide an alloy powder sheet made of powders of self-melting alloy and thermoplastic acryl resin, attach the sheet to a metal substrate by wetting the sheet by a solvent such as toluene, and heat under atmosphere to a melting temperature.

Japanese patent publication 55-21802 proposes to provide a thin tape by kneading powders of TiC type alloy with a synthetic resin and sinter the tape under a pressed condition to form a sintered sheet which is then attached to a mold of a substrate. By molding the substrate in the mold having the sintered tape attached thereto, it is possible to provide a sintered alloy layer on the substrate.

According to the process proposed by the Japanese patent application No. 50-9398, the resin in the alloy powder sheet functions to make the sheet adhere to the metal substrate as long as the temperature is between 200° and 300° C. It has been found, however, that under a further high temperature the resin is burnt or dissipated by heat so that the adhesive power of the alloy sheet to the substrate is no longer maintained. This property produces problems when the alloy sheet is to be attached to a slanted surface, a curved surface or a downwardly faced surface because the sheet cannot be held in position during the sintering process. The process as proposed by the Japanese patent publication 55-21802 may not have the above problems, however, it requires increased process steps to that it is disadvantageous in terms of the manufacturing cost.

Japanese patent publication 53-19540 proposes to use a sheet containing alloy powders of a high melting point superimposed on a second sheet containing alloy powders of a low melting point for sintering on a metal substrate. It should however be noted that in the proposed process it is required for sintering to have the alloy powders molten to some extent so that a high sintering temperature, usually higher than 1000° C., is generally required. Such high sintering temperature causes distortions in the metal substrate. Further, the process is difficult to apply to a metal substrate of a relatiely low melting point.

OBJECT OF THE INVENTION

It is therefore an object of the present invention to provide an alloy sheet which can be sintered on a metal substrate at a relatively low temperature.

Another object of the present invention is to provide a novel alloy sheet which can advantageously be used for forming a sintered layer on a metal substrate.

SUMMARY OF THE INVENTION

The present invention is based on a concept of utilizing a physical property of ultra-fine metal powders comprised of metal powders having a powder size less than 1 micron. Such ultra-fine metal powders may include powders of Cu, Ni, Co, Fe or other metals and they are characterized by a substantially lower melting point. In case of nickel powders having a powder size of 7 microns, it has been required to heat the material to at least 1050° C. for sintering. It should however be noted that in case of ultra-fine powders of nickel, sintering starts in an atmosphere of nitrogen of about 300° C. and a substantial extent of sintering progresses at 500° C. The present invention utilizes this feature of ultra-fine metal powders.

According to the present invention, the aforementioned objects and other objects can be accomplished by a metal powder sheet comprising metal powders, sinter-assisting agents including ultra-fine metal powders having a sintering start temperature lower than that of the first mentioned metal powders and a resin binder. The resin binder may be an acryl resin or any other suitable resin. In use, the metal powder sheet is adhered to a surface of a metal substrate sintered at an elevated temperature to produce a sintered layer of a required property on the metal substrate.

With the metal powders of the present invention, sintering starts at a relatively low temperature so that it can be used to form a sintered layer even on a substrate of a low melting point, such as an aluminum alloy substrate. Further, it is also possible to prevent thermal distortions of the substrate.

BRIEF DESCRIPTIONS OF THE DRAWINGS

The present invention will now be described with reference to examples. The metal powder sheet in accordance with the present invention is formed by kneading the metal powders and the sinter-assist agents with the resin binder and thereafter rolling the mixture.

Metal Powders

The metal powders have physical properties required for the sintered layer on the metal substrate. In order to provide a wear-resistance in the metal substrate surface, the metal powders may be powders of a metal containing one or more of P, Mo, Cr, C and Fe. Powder size has a great influence on the porousity of the sintered layer and it is preferable that the powder size be finer than 150 mesh. With the powder size coarser than 150 mesh will increase the pore size so that there will be an adverse effect on the wear-resistance.

Sinter-Assisting Agent

Figure 1:
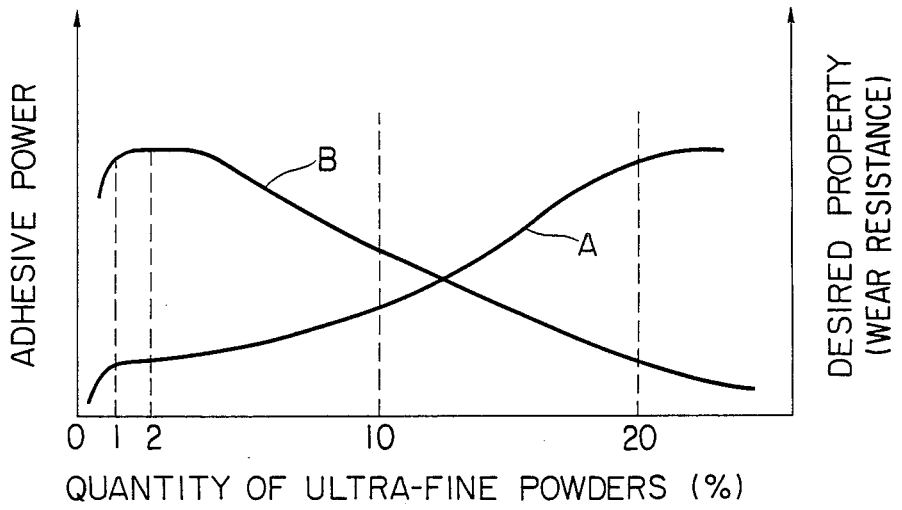
FIG. 1 is a diagram showing the effect of the sinter-assist agent.

It is preferable to use ultra-fine powders of Ni, Cu, Co or Fe as the sinter-assisting agents in an amount 1 to 20% in weight in the final mixture. The term "ultra-fine powders" used herein means metal powders having an average powder size smaller than 1 micron. The present invention intends to utilize the physical property of the ultra-fine metal powders so that the sintering start temperature is very low. In the present invention, the ultra-fine powders function as a binder for the metal powders in the sintering process. It should therefore be understood that if the quantity of the ultra-fine powders is less than 1 weight %, the powders can no longer function as the binder. With the quantity of the ultra-fine powders greater than 20% causes a decrease in the quantity of the metal powders which are contained for improving the physical properties. Therefore, the physical property such as the wear-resistance of the sintered layer will be decreased to an undesirable extent. Referring to FIG. 1, the curve A designates the binding power for the metal powders and the curve B designates the desired property, for example, the wear-resistance. It will be noted in FIG. 1 that the binding power drops abruptly with the quantity of the sinter-assist agent less than 1% so that the metal powders fall off the substrate in the sintering process. With the quantity of the sinter-assist agent greater than 20%, there is a decrease in the required property.

In the descriptions, the mixture of the metal powders and the sinter-assist agents will be referred to as the alloy powders.

Resin Binder

As the resin binder, an acryl resin may be used. It is preferable to use polymers or copolymers of acrylic esters and/or methacrylic esters, or copolymers of these esters and a monomer having a functional group copolymerizable with these esters.

The binder is mixed in an amount 6 to 1% in weight with 94 to 99% in weight of alloy powders. With the binder less than 1%, the sheet will become brittle due to insufficient adhesive power and it will become impossible to maintain a flexible property in the sheet. With the binder greater than 6%, there will be an adverse effect on the porousity of the sintered layer and the adhesion of the sintered layer to the substrate will become insufficient.

Metal Powder Sheet

The sheet may be formed in various ways. For example, the mixture of the alloy powders and the resin binder is added with 100 to 1000 weight part of a suitable solvent such as acetone, toluene or methylethylketone for 100 weight part of the resin binder, and the mixture thus obtained is kneaded to form a slip. The slip is then poured into a mold frame to have the solvent evaporated. Then, the mixture is passed through a pair of rolls to form a sheet of a suitable thickness, for example, 0.5 to 5.0 mm thick. It is also possible to knead the mixture of the alloy powders and the resin binder by heating the mixture to a suitable temperature.

Adhesion of the Powder Sheet

The powder sheet thus formed can be attached to the substrate surface by simply pressing the sheet to the substrate. However, if necessary, the sheet and/or the substrate surface may be applied with acryl resin which is the same one as used in the sheet as the binder in order to provide an increased adhesion alternatively, an adhesive sheet comprised of the same resin may be used for adhering the powder sheet to the substrate.

Sintering

It is required that heating be carried out in a non-oxidating atmosphere such as an atmosphere of nitrogen, argon, a reducing gas such as hydrogen, or a vacuum. Heating rate should preferably be less than 40° C./min. With the heating rate greater than 40° C./min., components of low boiling point in the resin binder are abruptly evaporated so that the powder sheet may be broken in the process or bubbles may be produced in the sheet. Such bubbles may cause the powder sheet to fall off the substrate in the sintering process.

It is preferred that a preheating be carried out prior to heating to the sintering temperature. The preheating may be carried out under a temperature between 150° and 380° C., preferably 200° and 350° C. for more than 5 minutes. With this preheating, there will be produced tar-pitch like substances through pyrolytic condensation of the resin binder in the powder sheet, the tar-pitch like substances providing an adhesive power sufficient to hold the powder sheet on the substrate even under a temperature above 300° C. It should therefore be noted that the powder sheet can be held in position even when it is subjected to vibrations or shock loads which may be applied thereto during the sintering process when the workpiece is being transferred.

With the preheating temperature lower than 150° C., there will not be a sufficient pyrolytic reaction of the resin binder so that the quantity of the tar-pitch like substances will be insufficient to provide a required adhesive power. With the preheating temperature higher than 380° C., the resin is abruptly resolved so that production of the tar-pitch like material will be insufficient. When the preheating time is less than 5 minutes, the production of the tar-pitch like material will also be insufficient so that it will be impossible to obtain a sufficient adhesive power. The preheating time should be determined in accordance with the preheating temperature and the type of the resin, however, it will not in general be necessary to carry out the preheating for more than 120 minutes.

[EXAMPLE]

Production of a Powder Sheet

Powders having an average powder size of 200 mesh are prepared from an alloy containing 1,76 weight % of P, 10.30 weight % of Mo, 4.96 weight % of Cr, 3.46 weight % of C, 1.11 weight % of Si, 0.53 weight % of Mn, 0.01 weight % of S and the balance Fe. The metal powders are then mixed in an amount 90 weight % with 10 weight % of ultra-fine powders of Ni having an average powder size of 0.1 microns to form alloy powders. The alloy powders are then mixed in an amount 95 weight % with 5 weight % of an acryl resin binder. The mixture is then added with toluene and kneaded in wet. The kneaded mixture is rolled into a powder sheet of 2 mm thick.

Adhesion of the Powder Sheet

Figure 2:
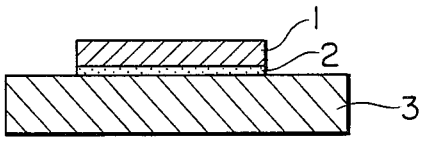
FIG. 2 is a sectional view showing a powder sheet attached to a substrate.

The powder sheet thus prepared is cut into specimens 1 of 1 cm square, which are adhered to substrates 3 of pure aluminum of 3 cm square as shown in FIG. 2. Polymer sheets of 30 microns thick of a resin having compositions as those of the resin in the powder sheet are used for adhering the powder sheets 1 to the substrates.

Preheating

The substrates 3 having the specimens 1 attached thereto are heated in an atmosphere of nitrogen at a heating rate of 10° C./min. to 300° C. and maintained at the temperature for 60 minutes. Thus, the tar-pitch like substances are produced without having the polymer sheet completely dissipated.

Sintering

Figure 3:
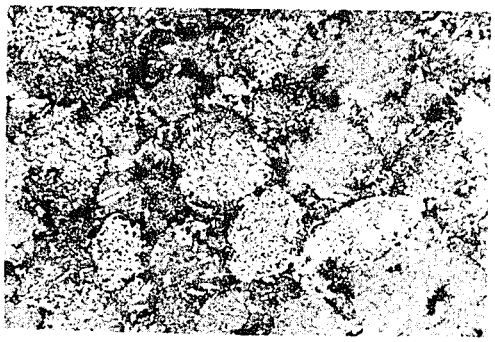
FIG. 3 is a microscopic photograph in 400 magnitude showing the structure of the sintered layer.

After the preheating, the substrates 3 having the specimens 1 thereon are heated in a nitrogen atmosphere at a heating rate of 50° C./min. to 570° C. and maintained at the temperature for 30 minutes. Thereafter, the test pieces are cooled at a cooling rate of 3° C./min. As a result, the metal powder sheets 1 are sintered on the substrates 3 to produce sintered layers of a high wear resistance. FIG. 3 shows the structure of the sintered layer thus obtained. The large grains designate the metal powders and fine grains between these large grains are ultra-fine powders or the sintered material produced from the ultra-fine powders. It will be noted that the sintering is sufficiently carried out throughout the layer. It will therefore be understood that the sintering temperature can significantly be decreased in accordance with the present invention.

We claim:

1. A metal powder sheet for forming a wear-resistant sintered layer on a substrate of an aluminum based material, said sheet comprising metal powders of Fe-based metal containing P, Mo, Cr and C, sinter-assisting agents including ultra-fine metal powders having a sintering start temperature lower than that of the first mentioned metal powders and an acrylic resin binder, said ultra-fine metal powders being powders of a metal containing at least one of Cu, Ni, Co and Fe finer than 1 micron, said sinter-assisting agents being added in an amount of 1 to 20 weight % of total amount of said first mentioned metal powders and said sinter-assisting agents, said metal powder sheet including 6 to 1 weight % of resin binder and 94 to 99 weight % of a mixture of the first mentioned metal powders and the sinter-assisting agent.

2. A metal powder sheet in accordance with claim 1 in which the first mentioned metal powders have powder size finer than 150 mesh.

3. A metal powder sheet in accordance with claim 1 in which said resin binder is selected from polymers and copolymers of acrylic esters, polymers and copolymers of methacrylic esters, and copolymers of these esters and a monomer having a functional group copolymerizable with these esters.

4. A sintering process including steps of preparing a metal powder sheet for forming a wear-resistant sintered layer on a substrate of an aluminum based material, said sheet comprising metal powders of Fe-based metal containing P, Mo, Cr and C, sinter-assisting agents including ultra-fine metal powders having a sintering start temperature lower than that of the first mentioned metal powders and an acrylic resin binder, said ultra-fine metal powders being powders of a metal containing at least one of Cu, Ni, Co and Fe and finer than 1 micron, said sinter-assisting agents being added in an amount of 1 to 20 weight % of total amount of said first mentioned metal powders and said sinter-assisting agents, metal powder sheet including 6 to 1 weight % of resin binder and 94 to 99 weight % of mixture of the first mentioned metal powders and the sinter-assisting agent, placing the metal powder sheet on a metal substrate, preheating the metal powder sheet and the metal substrate to a temperature between 150° and 380° C. for more than 5 9minutes and thereafter heating to a sintering temperature.

* * * * *